US010471744B2

(12) United States Patent
Tanaka

(10) Patent No.: US 10,471,744 B2
(45) Date of Patent: Nov. 12, 2019

(54) RECORDING MATERIAL CARTRIDGE UPDATING RESIDUAL AMOUNT INFORMATION INDICATING RESIDUAL AMOUNT OF RECORDING MATERIAL STORED IN MAIN BODY

(71) Applicant: BROTHER KOGYO KABUSHIKI KAISHA, Nagoya-shi, Aichi-ken (JP)

(72) Inventor: Nobumasa Tanaka, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/142,721

(22) Filed: Sep. 26, 2018

(65) Prior Publication Data

US 2019/0092053 A1 Mar. 28, 2019

(30) Foreign Application Priority Data

Sep. 28, 2017 (JP) ..... 2017-187419

(51) Int. Cl.
*B41J 2/175* (2006.01)
*B41J 11/00* (2006.01)
*B41J 15/04* (2006.01)

(52) U.S. Cl.
CPC ..... *B41J 11/0095* (2013.01); *B41J 2/17509* (2013.01); *B41J 2/17546* (2013.01);
(Continued)

(58) Field of Classification Search
CPC .... B41J 2/175; B41J 2/17509; B41J 2/17546; B41J 2/17566; B41J 2002/17569; B41J 11/0095; B41J 15/044
See application file for complete search history.

(56) References Cited

U.S. PATENT DOCUMENTS 6,012,794 A * 1/2000 Nakano ..... B41J 2/17513 347/7
8,696,095 B2 * 4/2014 Urabe ..... B41J 2/17566 347/7

(Continued)

FOREIGN PATENT DOCUMENTS

JP 62-96969 A 5/1987
JP 2002-307719 A 10/2002
JP 2012-234129 A 11/2012

*Primary Examiner* — Anh T Vo
(74) *Attorney, Agent, or Firm* — Merchant & Gould P.C.

(57) ABSTRACT

A recording material cartridge is attached to an image recording apparatus. A main body stores the recording material to be used in an image recordation process on a recording sheet by the image recording apparatus. A storage stores residual amount information indicating a current residual amount of the recording material. An interface receives consumption amount information. A reduction counter circuit subtracts a consumption amount based on the consumption amount information from the current residual amount to acquire the updated residual amount, and updates the residual amount information in the storage so that the residual amount information indicates the updated residual amount in a case where the consumption amount is larger than zero. The reduction counter maintains the residual amount information in the storage so that the residual amount information keeps on indicating the current residual amount in a case where the consumption amount is smaller than or equal to zero.

10 Claims, 11 Drawing Sheets

(52) U.S. Cl.
CPC ..... *B41J 2/17566* (2013.01); *B41J 15/044* (2013.01); *B41J 2002/17569* (2013.01)

(56) References Cited

U.S. PATENT DOCUMENTS

2002/0158925 A1 10/2002 Hara
2012/0081480 A1* 4/2012 Kura ..... B41J 2/1753
347/86

* cited by examiner

RECORDING MATERIAL CARTRIDGE UPDATING RESIDUAL AMOUNT INFORMATION INDICATING RESIDUAL AMOUNT OF RECORDING MATERIAL STORED IN MAIN BODY

CROSS REFERENCE TO RELATED APPLICATION

This application claims priority from Japanese Patent Application No. 2017-187419 filed Sep. 28, 2017. The entire content of the priority application is incorporated herein by reference.

TECHNICAL FIELD

The present disclosure relates to a recording material cartridge for storing a recording material such as ink or toner. The present disclosure also relates to an image recording system that includes a recording material cartridge and an image recording apparatus for recording an image on a recording medium by consuming recording material stored in the recording material cartridge.

BACKGROUND

There is known an image recording systems employing a cartridge as a supplier of recording material. Once the recording material in the cartridge has been completely exhausted, the empty cartridge is replaced by the user with a cartridge filled with recording material. To notify the user of the need to replace the cartridge in a timely manner, several techniques are known in the field of image recording systems. These techniques manage information that indicates the remaining amount of a recording material in a cartridge.

SUMMARY

In a conventional technique, the information indicating the remaining amount of a recording material may be stored in either a cartridge or the main body of an image recording apparatus. The conventional technique permits both addition and subtraction operations on the value of the information indicating the remaining amount depending on the situation. A value added to or subtracted from the information may be calculated in either the cartridge side or the main body side of the image recording apparatus. However, there is a possibility that the information indicating that the remaining amount cannot be appropriately updated on the basis of the amount of the recording material that has been actually consumed by the image recording apparatus.

It is an object of the present disclosure to provide a recording material cartridge and an image recording system capable of more accurately managing information that indicates the remaining amount of a recording material or the total consumption amount of the recording material.

In order to attain the above and other objects, the disclosure provides a recording material cartridge configured to be attached to an image recording apparatus. The recording material cartridge includes a main body, and an electric circuit. The main body stores the recording material to be used in an image recordation process on a recording sheet by the image recording apparatus. The electric circuit is accommodated in the main body. The electric circuit includes a storage, an interface, and a reduction counter circuit. The storage stores residual amount information indicating a current residual amount of the recording material stored in the main body. The interface is configured to be electrically connected to an external apparatus including the image recording apparatus to communicate with the external apparatus. The interface is configured to receive consumption amount information on a consumption amount of the recording material. The reduction counter circuit is configured to: subtract the consumption amount based on the consumption amount information from the current residual amount to acquire the updated residual amount; and update the residual amount information in the storage so that the residual amount information indicates the updated residual amount in a case where the consumption amount is larger than zero. The reduction counter is configured to maintain the residual amount information in the storage so that the residual amount information keeps on indicating the current residual amount in a case where the consumption amount is smaller than or equal to zero.

According to another aspect, the disclosure provides a recording material cartridge configured to be attached to an image recording apparatus. The recording material cartridge includes a main body, and an electric circuit. The main body stores the recording material to be used in an image recordation process on a recording sheet by the image recording apparatus. The electric circuit is accommodated in the main body. The electric circuit includes a storage, an interface, and a comparator circuit. The storage stores total consumption amount information indicating a current total consumption amount of the recording material stored in the main body. The interface is configured to be electrically connected to an external apparatus including the image recording apparatus to communicate with the external apparatus. The interface is configured to receive new residual amount information on an updated residual amount. The comparator circuit is configured to: compare the current residual amount with the updated residual amount based on the new residual amount information; and update the residual amount information in the storage so that the residual amount information indicates the update residual amount in a case where the updated residual amount is smaller than the current residual amount. The comparator circuit is configured to maintain the residual amount information in the storage so that the residual amount information keeps on indicating the current residual amount in a case where the updated residual amount is larger than or equal to the current residual amount information.

According to still another aspect, the disclosure provides a recording material cartridge configured to be attached to an image recording apparatus. The recording material cartridge includes a main body, and an electric circuit. The main body stores the recording material to be used in an image recordation process on a recording sheet by the image recording apparatus. The electric circuit is accommodated in the main body. The electric circuit includes a storage, an interface, and an addition circuit. The storage stores total consumption amount information indicating a current total consumption amount of the recording material stored in the main body. The interface is configured to communicate with an external apparatus including the image recording apparatus to communicate with the external apparatus. The interface is configured to receive consumption amount information on a consumption amount of the recording material. The addition circuit configured to: add the consumption amount based on the consumption amount information to the current total consumption amount to acquire the updated total consumption amount; and update the total consumption amount information in the storage so that the total consumption amount information indicates the updated total consumption amount in a case where the consumption amount is larger than zero. The addition circuit is configured to maintain the total consumption amount information in the storage so that the total consumption amount information keeps on indicating the current total consumption amount in a case where the consumption amount is smaller than or equal to zero.

According to still another aspect, the disclosure provides a recording material cartridge configured to be attached to an image recording apparatus. The recording material cartridge includes a main body, and an electric circuit. The main body stores the recording material to be used in an image recordation process on a recording sheet by the image recording apparatus. The electric circuit is accommodated in the main body. The electric circuit includes a storage, an interface, and a comparator circuit. The storage stores total consumption amount information indicating a current total consumption amount of the recording material stored in the main body. The interface is configured to communicate with an external apparatus including the image recording apparatus to communicate with the external apparatus. The interface is configured to communicate with an external apparatus including the image recording apparatus to communicate with the external apparatus. The interface is configured to receive new total consumption amount information on an updated total consumption amount. The comparator circuit is configured to: compare the current total consumption amount with the updated total consumption amount; and update the total consumption amount information in the storage so that the total consumption amount information indicates the updated total consumption amount in a case where the updated total consumption amount is larger than the current total consumption amount. The comparator circuit is configured to maintain the total consumption amount information in the storage so that the total consumption amount information keeps on indicating the current total consumption amount in a case where the updated total consumption amount is smaller than or equal to the current total consumption amount information.

BRIEF DESCRIPTION OF THE DRAWINGS

The particular features and advantages of the disclosure as well as other objects will become apparent from the following description taken in connection with the accompanying drawings, in which.

DETAILED DESCRIPTION

First Embodiment

Figure 1:
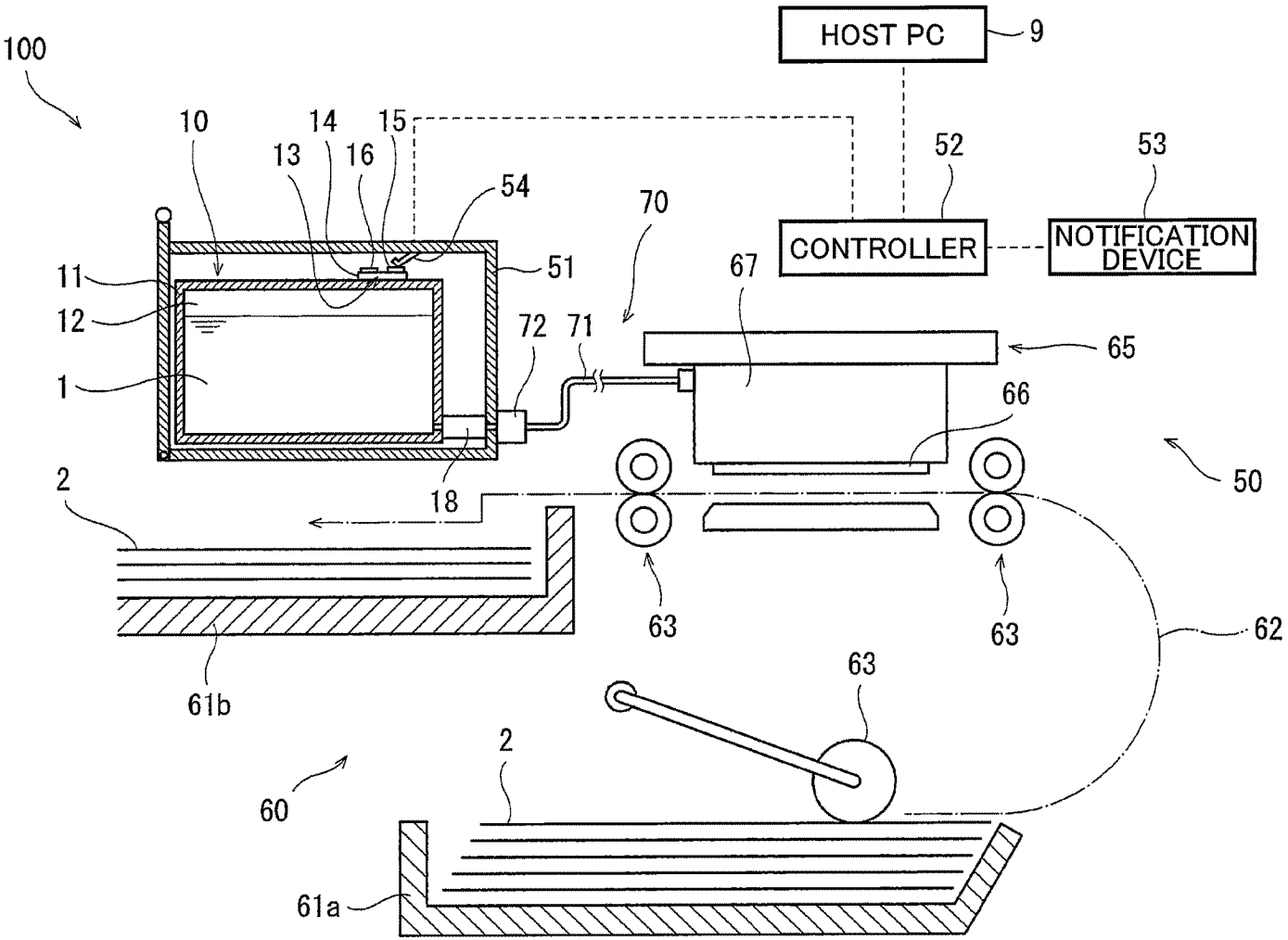
FIG. 1 is a conceptual diagram illustrating an image recording system according to a first embodiment.
Figure 2:
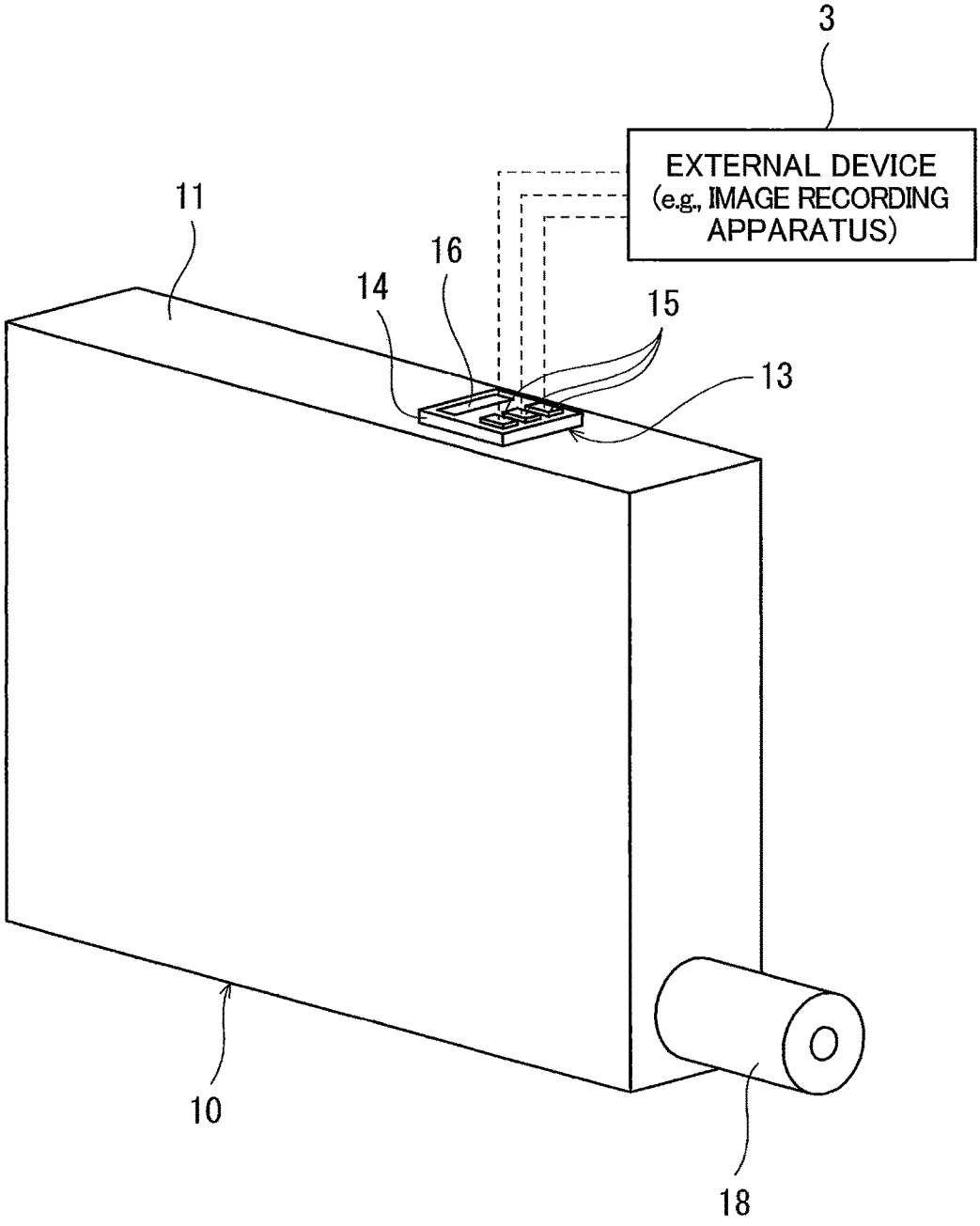
FIG. 2 is a perspective view of a recording material cartridge according to the first embodiment.

FIG. 1 is a conceptual diagram illustrating an image recording system 100 according to a first embodiment. FIG. 2 is a perspective view of a recording material cartridge 10 according to the first embodiment.

The image recording system 100 includes the recording material cartridge 10 and an image recording apparatus 50. The recording material cartridge 10 includes a cartridge main body 11. The cartridge main body 11 includes a storage chamber 12. The storage chamber 12 stores recording material 1. A cartridge attachment portion 51 is disposed in a housing of the image recording apparatus 50. The recording material cartridge 10 is detachably attached to the cartridge attachment portion 51. The image recording apparatus 50 records an image on a recording medium 2 by consuming the recording material 1 stored in the recording material cartridge 10 currently attached to the cartridge attachment portion 51. In the image recording system 100, the recording material cartridge 10 serves as a supplier to supply the recording material 1 to the image recording apparatus 50.

In the first embodiment, the recording material 1 is ink, and the recording material cartridge 10 is an ink cartridge that stores ink, for example. The image recording apparatus 50 is an inkjet printer that records an image on the recording medium 2 by consuming the ink stored in the ink cartridge. The recording material 1 may be toner, instead of ink. The toner may include a carrier. Additionally, the recording material cartridge 10 may be a toner cartridge. The image recording apparatus 50 may be a laser printer.

A configuration and an operation of the image recording system 100 will be described below while the inkjet printer is used as an example of the image recording apparatus 50. So, in the following description, the image recording apparatus 50, the recording material cartridge 10, and the recording material 1 are also referred to as the inkjet printer 50, the ink cartridge 10, and the ink 1, respectively. The inkjet printer 50 includes a feeder 60, an image forming device 65, an ink supply device 70, a feeding tray 61*a*, a discharge tray 61*b*, and a feeding path 62. The feeder 60 conveys the recording medium 2 placed on the feeding tray 61*a* to the discharge tray 61*b* along the feeding path 62. The feeder 60 includes a plurality of rollers 63 and a feeding actuator 64 (see FIG. 3). The feeding actuator 64 rotates the plurality of rollers 63. The image forming device 65 includes an inkjet head 66, a carriage 67, and a scanning actuator 68 (see FIG. 3). The inkjet head 66 ejects the recording material 1 onto the recording medium 2 conveyed along the feeding path 62. The carriage 67 holds the inkjet head 66. The scanning actuator 68 drives the carriage 67 to scan in a main scanning direction perpendicular to a direction in which the recording medium 2 is conveyed. The inkjet head 66 includes an ink channel (not illustrated), a nozzle (not illustrated), and a head actuator 69 (see FIG. 3). The ink 1 flows through the ink channel (not illustrated). The nozzle (not illustrated)

ejects the ink 1 at a downstream end of the ink channel (not illustrated). The head actuator 69 provides ejection energy for the ink 1 in the ink channel (not illustrated) so that the ink 1 is ejected from the nozzle. The ink supply device 70 supplies the ink 1 in the ink cartridge 10 to the ink channel (not illustrated) of the inkjet head 66. For example, the ink supply device 70 includes a flexible tube 71 having one end and another end. One end of the tube 71 is disposed on the cartridge attachment portion 51 and connected to a valve opening member 72. Another end of the tube 71 liquidly communicates with the ink channel (not illustrated) inside the inkjet head 66.

The ink cartridge 10 includes an opening/closing valve 18. The opening/closing valve 18 is of normally closed type, and opens or closes a bottom portion of the storage chamber 12. When the ink cartridge 10 is properly attached, the valve opening member 72 on the cartridge attachment portion 51 opens the opening/closing valve 18, allowing the storage chamber 12 to liquidly communicate with the ink channel (not illustrated) through the tube 71.

The image recording apparatus 50 further includes a controller 52 configured to control the actuators 64, 68, and 69. By the controller 52 controlling the actuators 64, 68, and 69, the ink 1 is ejected from the inkjet head 66 scanning in the main scanning direction while the recording medium 2 is conveyed from the feeding tray 61*a* to the discharge tray 61*b*. With the ink 1 landed on the recording medium 2, an image is recorded on the recording medium 2. Subsequently, the recording medium 2 on which the image has been recorded is conveyed to and placed on the discharge tray 61*b*.

Operation in the image recording apparatus 50 gradually decreases the remaining amount of the recording material 1 in the recording material cartridge 10 attached to the cartridge attachment portion 51. After the recording material cartridge 10 is emptied, the user removes the empty recording material cartridge 10 from the cartridge attachment portion 51. Then, the user newly attaches a recording material cartridge 10 filled with the recording material 1 to the cartridge attachment portion 51. This newly attached recording material cartridge by the user is not necessarily be a "new cartridge", and the newly attached recording material cartridge may be a "reused cartridge". The "reused cartridge" refers to the recording material cartridge 10 produced by refilling the recording material 1 into the storage chamber 12 of the recording material cartridge 10 that has been used at least once. The "new cartridge" refers to the recording material cartridge 10 that has yet to be used after the cartridge manufacturer shipped, or the recording material cartridge 10 that has never been refilled with the recording material 1.

The controller 52 is connected to a notification device 53. The notification device 53 notifies the user of information. Specifically, the controller 52 generates notification information to be notified to the user and controls the notification device 53 so that the user is notified of the generated notification information. For example, the notification device 53 is a display such as a liquid-crystal display disposed in the image recording apparatus 50. Alternatively, the notification device 53 may be a display of a host PC 9 communicably connected to the controller 52.

For example, the notification information is information indicating an remaining amount of the recording material 1 in the recording material cartridge 10 currently attached to the cartridge attachment portion 51. The notification information may be for prompting the user to replace the recording material cartridge 10 with new one. By receiving the notification, the user can prepare to replace the recording material cartridge 10 with new one (the new cartridge or the reused cartridge).

The recording material cartridge 10 includes a circuit board 13. The circuit board 13 includes a board 14, terminals 15, and an electric circuit 16. The terminals 15 and the electric circuit 16 are mounted on the board 14. The electric circuit 16 is configured as an integrated circuit (IC). The circuit board 13 is an "IC chip". The circuit board 13 is mounted on the cartridge main body 11 in such a manner that the terminals 15 are exposed on an outer surface of the recording material cartridge 10. The cartridge main body 11 has a rectangular box shape having an upper surface on which the circuit board 13 is mounted, for example.

The cartridge attachment portion 51 includes terminals 54. The terminals 54 is configured to be in contact with the terminals 15 in a case where the recording material cartridge 10 is properly attached to the cartridge attachment portion 51. The electric circuit 16 is electrically connected to the controller 52 by contact between the terminals 15 and 54. The electric circuit 16 may be driven by power supplied from an external apparatus 3 via the terminals 15 or may be powered by a battery built in the recording material cartridge 10. Here, the external apparatus 3 includes the image recording apparatus 50 and a resitter 4 which is described later.

Figure 3:
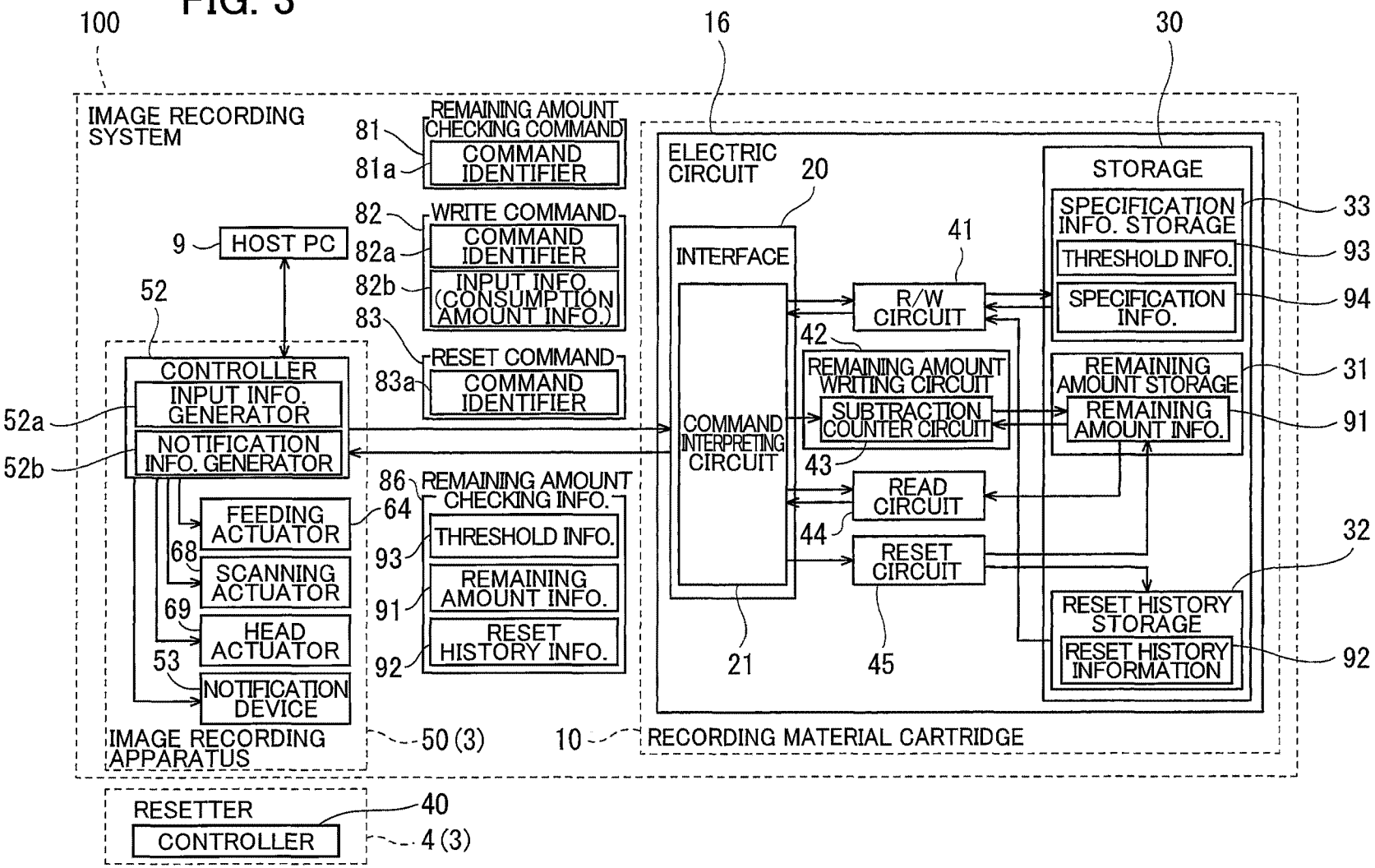
FIG. 3 is a block diagram illustrating a configuration of the image recording system according to the first embodiment.

FIG. 3 is a block diagram illustrating the configuration of the image recording system 100 according to the first embodiment. As illustrated in FIG. 3, the controller 52 is electrically connected to the host PC 9 and the controller 16. The controller 52 includes an input information generator 52*a* and a notification information generator 52*b*. The electric circuit 16 includes a storage 30, an interface 20, a read/write (R/W) circuit 41, a remaining amount writing circuit 42, and read circuits 44 and 45. The remaining amount writing circuit 42 includes a subtraction counter circuit 43. The storage 30 stores information on the recording material cartridge 10. The storage 30 includes a remaining amount storage 31, a reset history storage 32, and a specification information storage 33. The remaining amount storage 31 stores remaining amount information 91. The reset history storage 32 stores reset history information 92.

The remaining amount information 91 is information on the remaining amount of the recording material 1 stored in the storage chamber 12. The "information on the remaining amount" may be information indicating a numerical value [p1] of the current remaining amount of the recording material 1. Alternatively, the "information on the remaining amount" may be information indicating the ratio of the current remaining amount of the recording material 1 to the remaining amount of the recording material 1 in the full filling state. Note that the ratio is not limited to a percentage. For example, the ratio may be expressed as a fraction of 256, that is, a ratio of parts per 256. Specifically, the value indicating the full filling state (hereinafter referred to as "full value") may be expressed as $(FF)_{16}$. The value indicating the empty state (hereinafter referred to as "empty value") may be expressed as $(00)_{16}$. Accordingly, the resolution of the ratio can be maximized while data volume of the remaining amount information 91 is kept to one byte (eight bits). Alternatively, the "information on the remaining amount" may be information indicating a numerical value that corresponds to the remaining amount of the recording material 1 and that indirectly represents the remaining amount of the recording material 1. For example, the "information on the remaining amount" may be information indicating the number of recording mediums 2 (the number of remaining printable sheets) on which images can be recorded by consuming the recording material 1 stored in the recording material cartridge 10.

The following describes the reset history information 92. If the recording material 1 is refillable, both the cartridge main body 11, which serves as a container of the recording material 1, and the electric circuit 16 need to have reusability. In a usual usage of the image recording system 100, the recording material 1 is refilled when the remaining amount information 91 indicates the empty value or a value close to the empty value. To obtain the reusability, therefore, the remaining amount information 91 needs to be resettable to the full value. The resitter 4 is a device used to reset the remaining amount information 91. The resetter 4 is configured to be connected to the interface 20 for example. The resitter includes a controller 40. The reset history information 92 is information indicating whether the remaining amount information 91 has been reset. For example, the reset history information 92 is one-bit data. In this case, "0" indicates no history of reset execution. "1" indicates presence of reset execution history. The reset history information 92 may store the number of times the remaining amount information 91 has been reset in addition to data about whether the remaining amount information 91 has been reset. In this case, the reset history information 92 may be two bits or more (one byte or two bytes, for example) of data.

The specification information storage 33 stores threshold information 93 and specification information 94. The threshold information 93 indicates a prescribed threshold value and is information used to determine whether the user is notified that the remaining amount of the recording material 1 is small. The threshold information 93 is compared with the remaining amount information 91. In a case where the value of the remaining amount information 91 is expressed as a ratio, the value of the threshold information 93 is also expressed as a ratio. In this case, the threshold information 93 is one-byte data. For example, the threshold value indicated by the threshold information 93 is $(55)_{16}$. In this case, in a state where the current remaining amount of the recording material 1 has decreased to approximately one-third of the full filling state, the user is notified that the remaining amount of the recording material 1 is small (the notification process will be described later). The specification information 94 includes, color information, country and region information, and IC version information, for example. The color information indicates the color(s) of the recording material 1. The country and region information indicates a destination of the recording material cartridge 10 or a location in which the recording material cartridge 10 is used. The IC version information indicates the version of the electric circuit 16.

The storages 31 to 33 may be implemented by a single memory device or may be implemented by a plurality of memory devices having readable/writable device(s) and read-only device(s). Since the remaining amount information 91 and the reset history information 92 are to be rewritten, the remaining amount information 91 and the reset history information 92 are stored in the readable/writable device(s) of the memory device. The various specification information 94 is also stored in the corresponding readable/writable device. The threshold information 93 may be stored in a read-only device since the threshold information 93 does not particularly need to be rewritten.

The interface 20 inputs and outputs information to and from the external apparatus 3. Specifically, a remaining amount checking command 81, a write command 82, or a reset command 83 are input from the external apparatus 3 to the interface 20. The remaining amount checking command 81 is an instruction to read out the information stored in the storage 30. The write command 82 and the reset command 83 are instructions to overwrite the information (specifically, the remaining amount information 91 and the reset history information 92) stored in the storage 30.

As a response to reception of a command to read out information, the interface 20 outputs to the external apparatus 3 the information according to the received command. As a response to reception of a command to write information, the interface 20 may output the information indicating that the command execution is complete after the command execution is complete.

There is no particular limitation to a programming language that describes the commands 81 to 83. For example, the programming language may be the C language or the C++ language. The commands 81 to 83 include respectively command identifiers 81*a* to 83*a* for respectively identifying themselves.

The command to read out information includes the remaining amount checking command 81. The remaining amount checking command 81 is generated by the controller 52, and then output from the image recording apparatus 50. Specifically, the remaining amount checking command 81 is output when the image recording apparatus 50 checks the remaining amount of the recording material 1. The remaining amount checking command 81 instructs the electric circuit 16 to read and output the remaining amount information 91 and the threshold information 93. After receiving the remaining amount information 91 and the threshold information 93 from the cartridge 10, the controller 52 compares the received remaining amount information 91 with the received threshold information 93. When the current remaining amount of the recording material 1 is smaller than the threshold value, the notification information generator 52*b* generates notification information indicating that the current remaining amount is small.

The commands to overwrite information includes the write command 82 and the reset command 83. The write command 82 is generated by the controller 52, and then output from the image recording apparatus 50. Specifically, the write command 82 is output when the recording material 1 is consumed (or has been consumed) through the image recordation on the sheet(s) by the image recording apparatus 50. The write command 82 instructs the electric circuit 16 to update the remaining amount information 91. The write command 82 includes input information 82*b* in addition to the corresponding command identifier 82*a*. The input information 82*b* is used to overwrite the remaining amount information 91. The input information generator 52*a* generates the input information 82*b* in accordance with the consumption amount of recording material 1 consumed in the image recording. The input information 82*b* is then added to the write command 82.

In the first embodiment, the input information 82*b* is consumption amount information indicating the consumption amount of the recording material 1 consumed in the image recording by the image recording apparatus 50. The consumption amount information is to be subtracted from the remaining amount information 91 for updating the remaining amount information 91. Thus, in a case where the remaining amount information 91 indicates a ratio, the consumption amount information indicates a ratio. In this case, the consumption amount information is one-byte data. On the basis of the characteristics of a subtraction process (S33) described later, the consumption amount information normally indicates a positive value. In a case where the remaining amount information 91 is information other than the number of remaining printable sheets, the input information generator 52*a* generates the input information 82*b* by converting the number of operations, which the head actuator 69 has performed, into a numerical value for the consumption amount information.

The reset command 83 is output from the resetter 4 connected to the cartridge 10. Specifically, the reset command 83 is output when the recording material 1 is refilled. The reset command 83 instructs the electric circuit 16 to reset the remaining amount information 91 as described above.

The interface 20 includes a command interpreting circuit 21. The command interpreting circuit 21 interprets the commands 81 to 83. The command interpreting circuit 21 identifies (interprets) an input command among the commands 81 to 83 on the basis of the respective command identifiers 81*a* to 83*a*. In a case where the remaining amount checking command 81 is input, the command interpreting circuit 21 controls the R/W circuit 41 and the read circuit 44 to operate. Then, the R/W circuit 41 and the read circuit 44 executes the remaining amount checking command 81. In a case where the write command 82 is input, the command interpreting circuit 21 controls the remaining amount writing circuit 42 to operate. Then, the remaining amount writing circuit 42 executes the write command 82. In a case where the reset command 83 is input, the command interpreting circuit 21 controls the reset circuit 45 to operate. Then, the reset circuit 45 executes the reset command 83.

Figure 4:
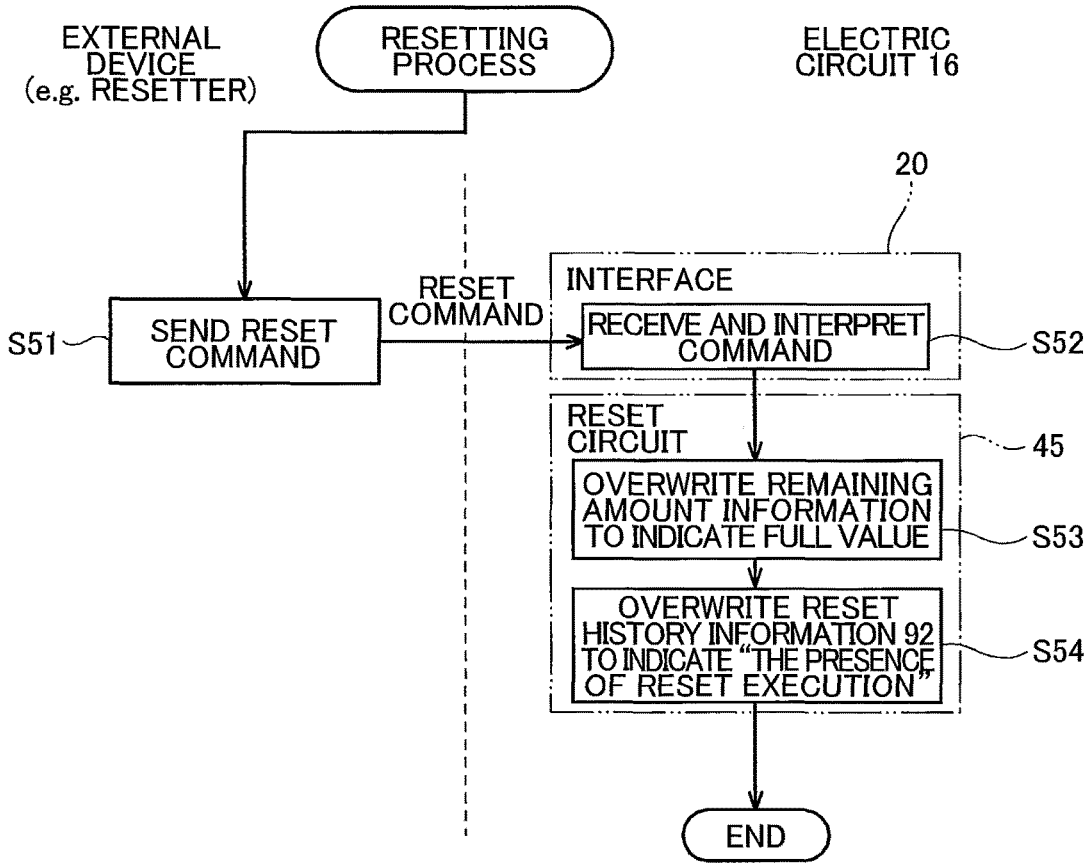
FIG. 4 is a flowchart illustrating a process of resetting remaining amount information according to the first embodiment.

Operation of the electric circuit 16 will be described below with reference to flowcharts. FIG. 4 is a flowchart of the process illustrating resetting the remaining amount information 91 to the full value. In a case where the reset command 83 is transmitted from the resetter 4 to the electric circuit 16 in S51, in S52 the command interpreting circuit 21 interprets the command 83, which has been input, and controls the reset circuit 45 to operate according to the command 83. Accordingly, in S53 the reset circuit 45 accesses the remaining amount storage 31 to overwrite the remaining amount information 91 to indicate the full value, and in S54 accesses the reset history storage 32 to overwrite the reset history information 92 to indicate a value indicating "the presence of reset execution" (e.g., a value "1"). In a case where the reset history information 92 is the information indicating the number of times the remaining amount information 91 has been reset, then the reset history information 92 is incremented by "1".

Figure 5:
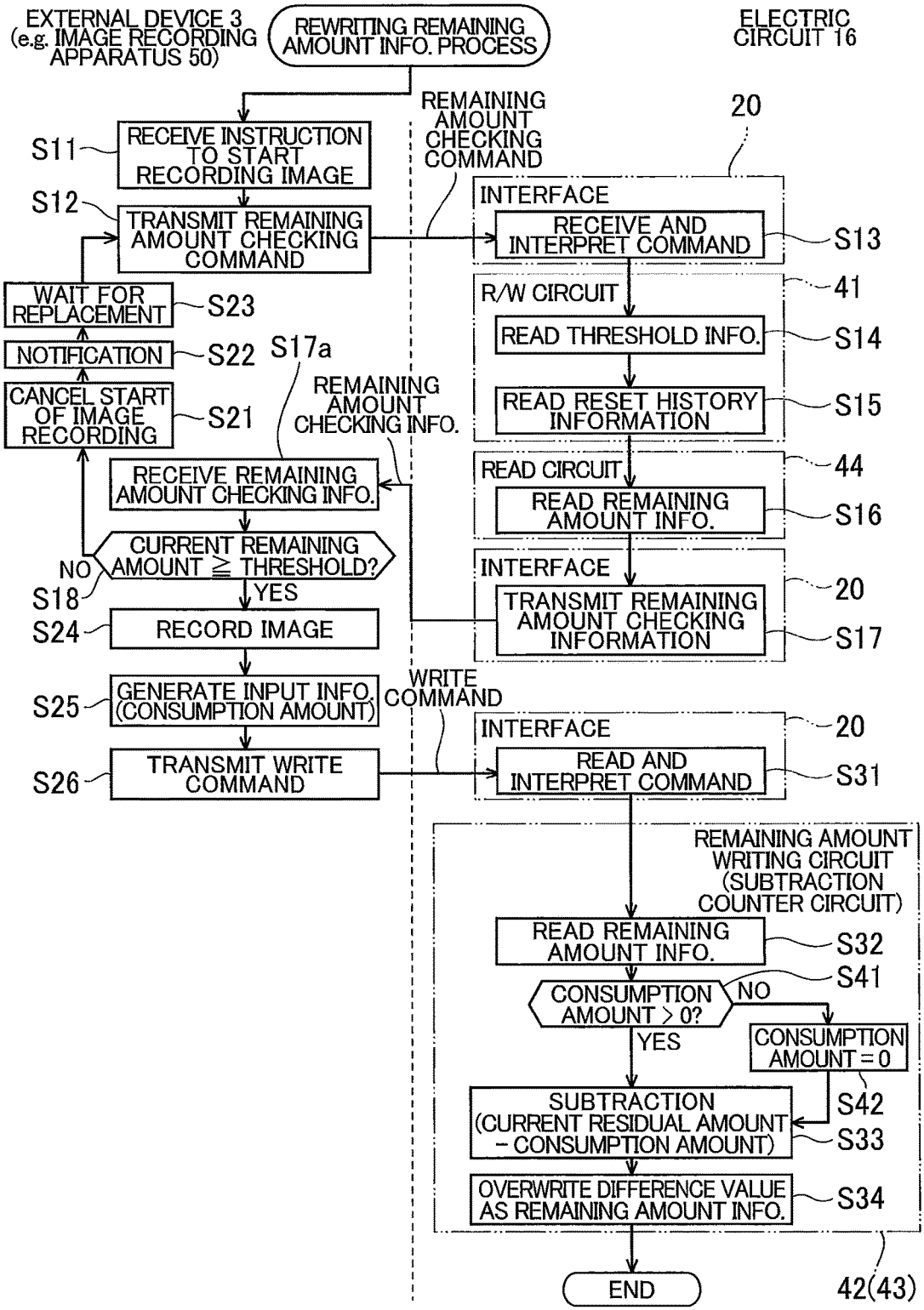
FIG. 5 is a flowchart illustrating a process of rewriting the remaining amount information according to the first embodiment.

FIG. 5 is a flowchart illustrating the process of rewriting the remaining amount information 91 according to image recordation. In a case where the host PC 9 outputs an instruction to start recording an image to the image recording apparatus 50 in S11, in S12 the controller 52 transmits the remaining amount checking command 81 to the electric circuit 16. In S13 the command interpreting circuit 21 interprets the command 81 that has been input, and controls the R/W circuit 41 and the read circuit 44 to operate according to the command 81. Accordingly, in S14 the R/W circuit 41 accesses the specification information storage 33 to read the threshold information 93, and in S15 accesses the reset history storage 32 to read the reset history information 92. In S16 the read circuit 44 accesses the remaining amount storage 31 to read the remaining amount information 91. In S17 the interface 20 transmits remaining amount checking information 86 to the controller 52. Here, the remaining amount checking information 86 includes the remaining amount information 91, the reset history information 92, and the threshold information 93 read by the circuits 41 and 44. In S17*a* the controller 52 receives the remaining amount checking information 86 from the interface 20. In S18 the controller 52 compares the remaining amount information 91 with the threshold information 93 to determine whether the current remaining amount is equal to or higher than the threshold value.

In a case where the value of the remaining amount information 91 is less than the value of the threshold information 93 (S18: NO), in S21 the controller 52 cancels start of the image recording. In S22 the notification information generator 52*b* generates the notification information indicating that the remaining amount is small, and the notification device 53 notifies that the remaining amount is small, on the basis of the notification information. In S23 the controller 52 waits for the recording material cartridge 10 to be replaced. After the recording material cartridge 10 has been replaced, in S12 the controller 52 transmits the remaining amount checking command 81.

In a case where the current remaining amount is equal to or larger than the threshold value (S18: YES), in S24 the controller 52 executes the image recording process. In S25 the input information generator 52*a* generates the input information 82*b* in accordance with the amount of the recording material 1 consumed in the image recording. In S26 the controller 52 transmits the write command 82, which includes the generated input information 82*b*, to the electric circuit 16. The write command 82 may be transmitted in S26 after the image recordation process based on the instruction received in S11 is complete. Alternatively, the write command 82 may be transmitted in S26 each time a prescribed amount of the image recordation is performed, for example, each time a prescribed area of the image is recorded or prescribed number of sheets is recorded.

In S31 the command interpreting circuit 21 interprets the write command 82 that has been input, and controls the remaining amount writing circuit 42 having the subtraction counter circuit 43 to operate according to the command 82. The subtraction counter circuit 43 subtracts the consumption amount from the current remaining amount. Here, the consumption amount is specified by the received consumption amount information (the input information 82*b*) by the interface 20. The current remaining amount is specified by the remaining amount information 91, which is currently stored in the remaining amount storage 31. More specifically, in S32 the subtraction counter circuit 43 accesses the remaining amount storage 31, and reads the remaining amount information 91 to specify the remaining amount. In S33 the subtraction counter circuit 43 calculates a difference value by subtracting the consumption amount from the remaining amount. In S34 the subtraction counter circuit 43 writes (overwrites) the difference value as the updated (new) remaining amount information 91 in the remaining amount storage 31. Steps S31-S34 are executed each time the interface 20 receives the write command.

The value of the appropriate consumption amount information is normally positive. While the recording material cartridge 10 is attached to the image recording apparatus 50, the value of the remaining amount information 91 stored in the remaining amount storage 31 gradually decreases from the full value to the empty value. However, in a case where the input information 82*b* (consumption amount information) in the write command 82 is a negative value due to some problems, the value of the remaining amount information 91 would be increased as a result of the subtraction process in S33. Consequently, the value of the remaining amount information 91 would not match the actual situation where the remaining amount of the recording material 1 gradually decreases along with the consumption of the recording material 1.

In light of the circumstances, in a case where the value of the consumption amount information (the consumption amount) is equal to or less than zero (S41: NO), in S42 the subtraction counter circuit 43 replaces the value of the consumption amount information with a value of zero after the process of reading the remaining amount information 91 (S32) and before the subtraction process (S33). Subsequently, the subtraction counter circuit 43 executes the subtraction process S33. In a case where the value of the consumption amount information is positive (S41: YES), the subtraction counter circuit 43 executes the subtraction process S33 using the value of the consumption amount information. Therefore, in a problematic situation where the value of the consumption amount information is equal to or less than zero, the numerical value of the remaining amount information 91 remains unchanged. That is, the numerical value of the remaining amount information 91 is not substantially changed from the value before the write command 82 is input.

In the image recording system 100 according to the first embodiment, the remaining amount writing circuit 42 (the subtraction counter circuit 43) mounted in the circuit board 13 only permits updates of the remaining amount information 91 to be a value less than before the update. In a conceivable case where the process S42 would not be performed even if input information with a negative value is output to the interface 20, the remaining mount would increase in the subtraction process S33. On the other hand, in the first embodiment, even if such erroneous information (input information with a negative value) is output to the interface 20, the remaining amount writing circuit 42 prevents the remaining amount information 91 from being overwritten using the erroneous information.

The image recording apparatus 50 determines whether the remaining amount of the recording material 1 is small on the basis of the remaining amount information 91. Since the image recording apparatus 50 does not overestimate the remaining amount of the recording material 1 on the basis of erroneous remaining amount information 91 (information indicating the value greater than the actual remaining amount), the image recording apparatus 50 is prevented from recording an image when no recording material 1 remains in the recording material cartridge 10, and discharging the recording medium 2 into the discharge tray 61*b* without an image being recorded. Moreover, this configuration prevents the image recording apparatus 50 from performing a recording operation of an image when no recording material 1 remains, and thus prevents air from entering into the image forming device 65.

The interface 20 receives the reset command 83 which is an instruction to reset the remaining amount information 91 stored in the remaining amount storage 31 to the full value. The full value indicates that the remaining amount of the recording material 1 stored in the recording material cartridge 10 is full. The electric circuit 16 includes a remaining amount resetter (the reset circuit 45), separately from the remaining amount writing circuit 42. Here, the reset circuit 45 resets the remaining amount information 91 stored in the remaining amount storage 31 to the full value in response to reception of the reset command 83 via the interface 20. With this configuration, while the remaining amount writing circuit 42 only permits updates of the remaining amount information 91 to be a value less than before the update, the remaining amount information 91 is resettable to the full value, thereby ensuring reusability of the recording material cartridge 10. The process of increasing the remaining amount information 91 to the full value is executed by the circuit other than the remaining amount writing circuit 42, and is executed only when the dedicated reset command 83 is input. This ensures that the recording material cartridge 10 has reusability without preventing the remaining amount writing circuit 42 from updating the remaining amount information 91 to a value less than before the update.

The electric circuit 16 includes the reset history storage 32. The reset history storage 32 stores the reset history information 92. In a case where the remaining amount resetter (the reset circuit 45) has executed a reset, the reset history information 92 indicates that the reset has been executed. Thus, as a response to transmission of a command (e.g., the remaining amount checking command 81) to read out the reset history information 92 to the electric circuit 16, the controller 52 can receive the information (e.g., the remaining amount checking information 86 (see FIG. 3)) from the electric circuit 16 and can determine whether the recording material cartridge 10 attached to the cartridge attachment portion 51 is a "reused cartridge" on the basis of the received information (e.g., the remaining amount checking information 86 (see FIG. 3)). Although not illustrated in the flowchart in FIG. 5, the notification information generator 52*b* of the controller 52 may generate information indicating that the reused cartridge is attached. Additionally, the controller 52 may also notify the user of this information through the notification device 53. With this configuration, the user can be notified whether the reused cartridge is in use.

Second Embodiment

Figure 6:
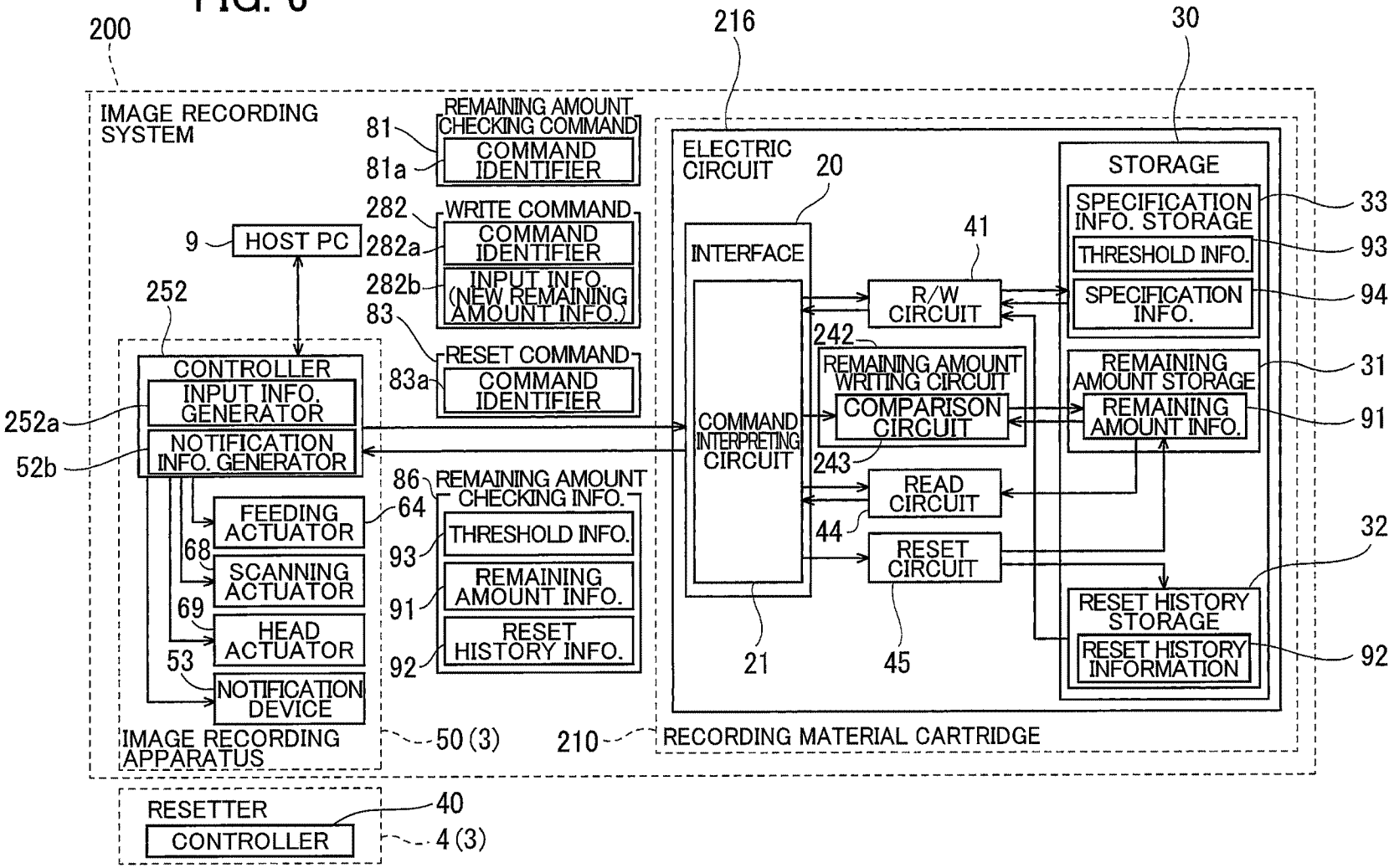
FIG. 6 is a block diagram illustrating a configuration of an image recording system according to a second embodiment.
Figure 7:
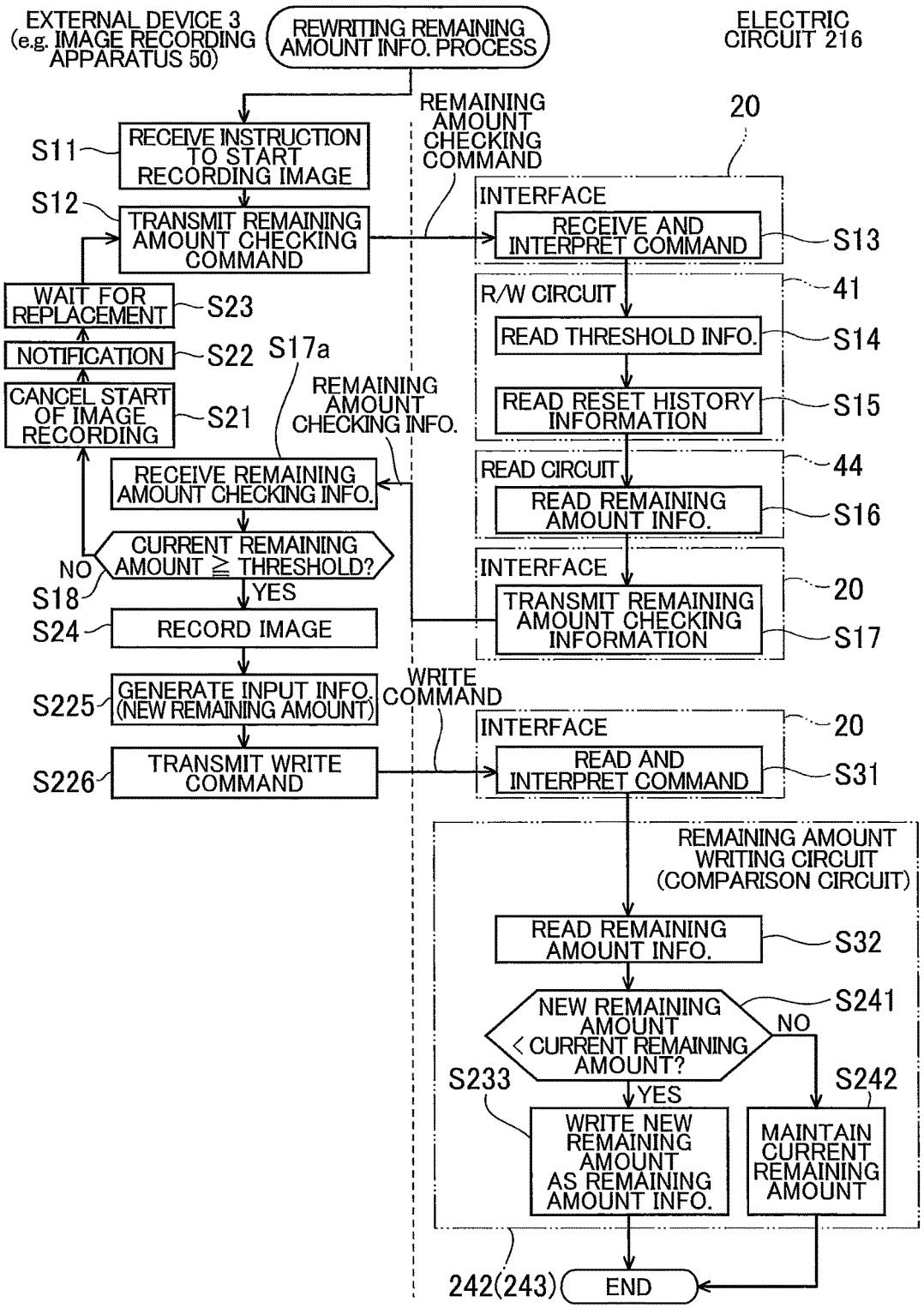
FIG. 7 is a flowchart illustrating a process of rewriting remaining amount information according to the second embodiment.

Next, a second embodiment will be described with reference to FIGS. 6 and 7, wherein like parts and components are designated with the same reference numerals to avoid duplicating description. As illustrated in FIG. 6, an image recording system 200 includes a recording material cartridge 210 instead of the recording material cartridge 10. The recording material cartridge 210 has a remaining amount writing circuit 242 including a comparison circuit 243 instead of the remaining amount writing circuit 42. The image recording apparatus 50 includes a controller 252 having an input information generator 252*a* and the notification information generator 52*b*.

Similarly to the controller 52 of the first embodiment, the controller 252 reads out the remaining amount checking information 86 and determines whether the current remaining amount is equal to or larger than the threshold value, that is, whether the remaining amount is small, on the basis of the remaining amount checking information 86. In the first embodiment, in a case where the image recordation is performed, the information specifying the consumption amount of the recording material 1 is generated as the input information 82*b*, and the electric circuit 16 obtains the new remaining amount information by subtracting the consumption amount from the current remaining amount. In the second embodiment, in S225 the input information generator 252*a* obtains new remaining amount information by subtracting the consumption amount from the current remaining amount. Here, in S12 the controller 252 transmits the remaining amount checking command 81 to the interface 20 before an image is recorded in S24, and in S17*a* the controller 52 receives the current remaining amount checking information 86 including the current remaining amount information 91 from the interface 20 before generating the input information 282*b*. In S226 the controller 252 transmits a write command 282 to the electric circuit 216. The write command 282 includes a command identifier 282*a* and the generated input information 282*b* on the new remaining amount information.

The command interpreting circuit 21 interprets the write command 282 that has been input, and controls the remaining amount writing circuit 242 (the comparison circuit 243) to operate according to the command 282. The comparison circuit 243 compares the current remaining amount with the new remaining amount. The current remaining amount is specified by the remaining amount information 91 currently stored in the remaining amount storage 31. The new remaining amount is specified by the new remaining amount information received via the interface 20 in S31. Specifically, in S32 the comparison circuit 243 accesses the remaining amount storage 31 to read the remaining amount information 91, similarly to the subtraction counter circuit 43 according to the first embodiment. In S241 the comparison circuit 243 compares the current remaining amount with the new remaining amount. In a case where the new remaining amount is smaller than the current remaining amount (S241: YES), in S233 the comparison circuit 243 writes the new remaining amount in the remaining amount storage 31 as the updated remaining amount information 91. In a case where the new remaining amount is equal to or larger than the current remaining amount (S241: NO), in S242 the comparison circuit 243 maintains the currently stored remaining amount information without overwriting (updating) the total consumption amount 391.

According to the second embodiment, the remaining amount writing circuit 242 (the comparison circuit 243) only permits updates of the remaining amount information 91 to be a value less than before the update. This configuration, therefore, prevents erroneous writing of the remaining amount information 91, similarly to the first embodiment.

Third Embodiment

Figure 8:
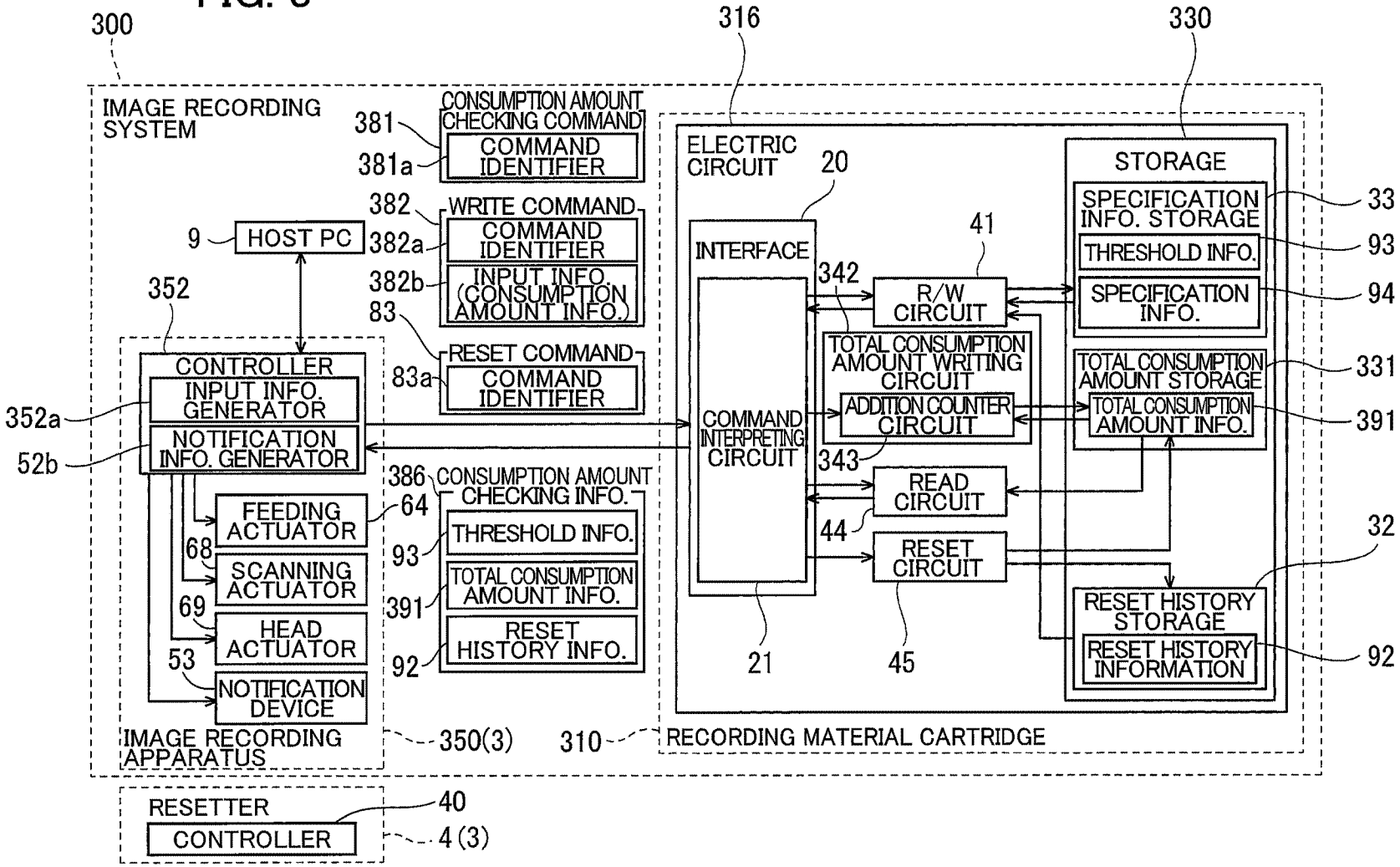
FIG. 8 is a block diagram illustrating a configuration of an image recording system according to a third embodiment.

Next, a recording system 300 according to a third embodiment will be described with reference to FIGS. 8 and 9, wherein like parts and components are designated with the same reference numerals to avoid duplicating description. The recording system 300 includes an image recording apparatus 350 and a recording material cartridge 310. The image recording apparatus 350 includes a controller 352 having an input information generator 352*a* and the notification information generator 52*b*. The recording material cartridge 310 includes an electrical circuit 316 having a storage 330 and a total consumption amount writing circuit 342. The consumption amount writing circuit 342 includes an addition counter circuit 343. In the first and second embodiments, the information on the remaining amount of the recording material 1 is stored in the corresponding storage 30 of the electric circuits 16 and 216. In the third embodiment, as illustrated in FIG. 8, the storage 330 includes a total consumption amount storage 331. The total consumption amount storage 331 stores total consumption amount information 391 on the total consumption amount of the recording material 1 which has been originally accommodated in the cartridge 310 and has been consumed through the image recordation for example. Similarly to the remaining amount information 91 according to the first embodiment, the total consumption amount information 391 may be a value indicating the total consumption amount or may be information indicating the ratio of the current total consumption amount to the total consumption amount in the empty state. The value of the threshold information 93 is used to determine whether the remaining amount of the recording material 1 is small, and, for example, the value of the threshold information 93 is $(AB)_{16}$. In this case, when the total consumption amount of the recording material 1 increases to approximately 67% of that in the empty state (that is, the remaining amount decreases to approximately 33% as in the first embodiment), the user is notified that the remaining amount is small.

Figure 9:
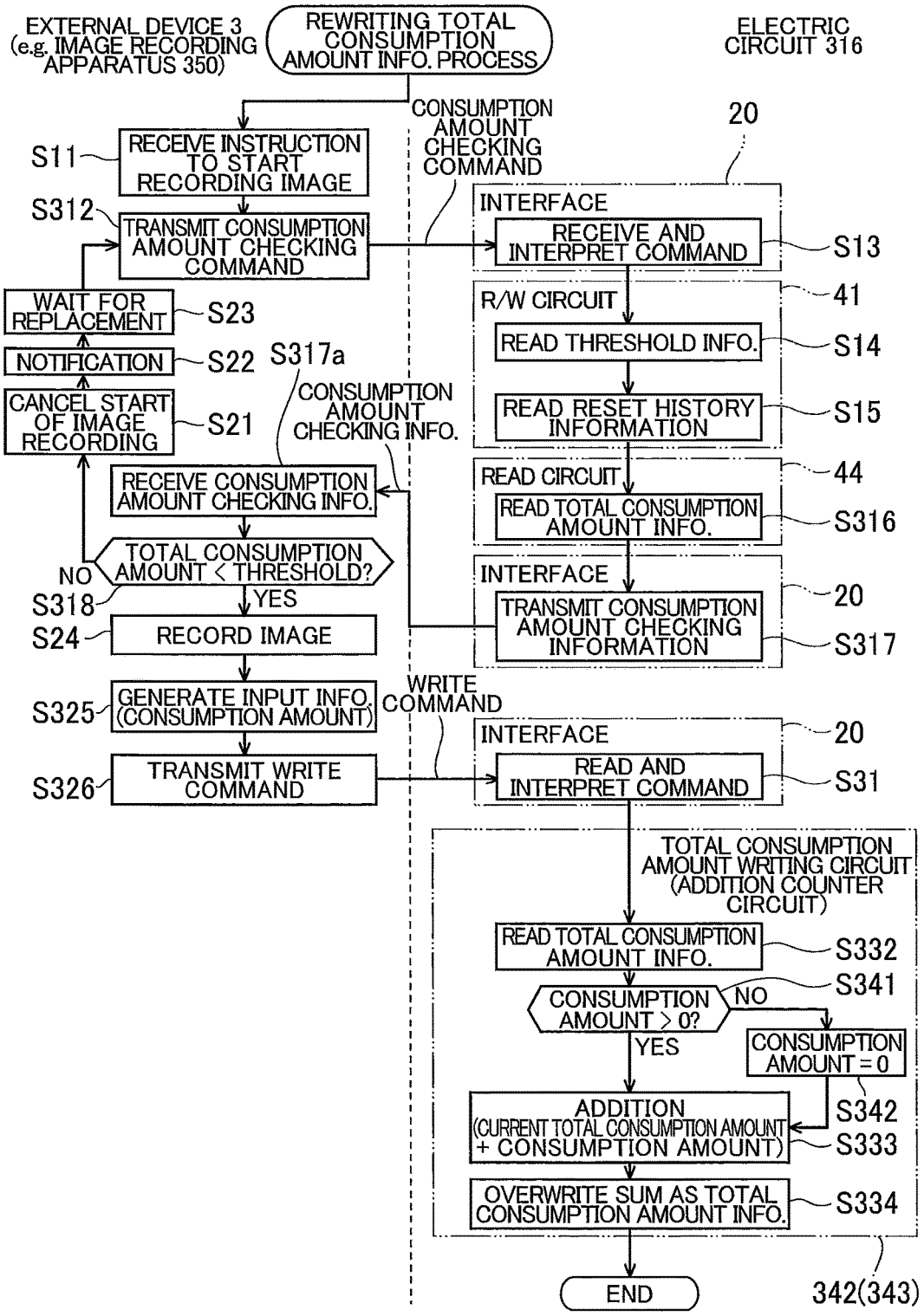
FIG. 9 is a flowchart illustrating a process of rewriting total consumption amount information according to the third embodiment.

As shown in FIG. 9, in a case where an instruction to start recording an image is input to the image recording apparatus 350 in S11, in S312 a controller 352 transmits a consumption amount checking command 381 including a command identifier 381*a*, instead of the remaining amount checking command 81 according to the first and second embodiments. In S13 the command interpreting circuit 21 interprets the command 381 based on the command identifier 381*a* input from the controller 352, and controls the R/W circuit 41 and the read circuit 44 to operate according to the command 381. The operation of the R/W circuit 41 is the same as that of the first or second embodiment. In S316 the read circuit 44 accesses the total consumption amount storage 331 to read the total consumption amount information 391. In S317 the interface 20 transmits consumption amount checking information 386 to the controller 352. Here, the consumption amount checking information 386 includes the total consumption amount information 391, the reset history information 92, and the threshold information 93 read by the circuits 41 and 44. In S317*a* the controller 352 receives the consumption amount checking information 386 from the interface 20. In S318 the controller 352 compares the total consumption amount information 391 with the threshold information 93 to determine whether the current total consumption amount is less than the threshold value.

In a case where the value of the total consumption amount information 391 is greater than the value of the threshold information 93 (S318: NO), that is, in a case where the remaining amount of the recording material 1 is determined to be small, the controller 352 executes the processes S21 to S23, similarly to the first and second embodiments. Subsequently, in S312 the controller 352 transmits the consumption amount checking command 381. In a case where the value of the total consumption amount information 391 is less than the value of the threshold information 93 (S318: YES), that is, in a case were the remaining amount of the recording material 1 is determined to be sufficient, in S24 the controller 253 performs the image recording process similarly to the first and second embodiments. In S325 the input information generator 352*a* generates input information 382*b* in accordance with the amount of the recording material 1 consumed in the image recording process by the image recording apparatus 350. In S326 the controller 352 transmits a write command 382, which includes an identifier 382*a* and the generated input information 382*b*, to the electric circuit 316. Similarly to the first embodiment, the input information 382*b* is the consumption amount information indicating the consumption amount of the recording material 1 consumed in the image recording process.

In S31 the command interpreting circuit 21 interprets the input command 382 based on the command identifier 382*a* input from the controller 352, and controls the total consumption amount writing circuit 342 (the addition counter circuit 343) to operate according to the command 382. Specifically, the addition counter circuit 343 adds the consumption amount to the current total consumption amount. The consumption amount is specified by the consumption amount information in the input information 382*b* received via the interface 20 in S31. The current total consumption amount is specified by the total consumption amount information 391 currently stored in the total consumption amount storage 331. Because of the characteristics of the processes executed by the addition counter circuit 343, the value of the appropriate consumption amount information is normally positive.

In a case where the value of the consumption amount information is positive (S341: YES), in S333 the addition counter circuit 343 adds the consumption amount to the current total consumption amount, and in S334 writes (overwrites) the resultant sum in the total consumption amount storage 331 as updated total consumption amount information. In a case where the value of the consumption amount information is equal to or less than zero (S341: NO), in S342 the addition counter circuit 343 replaces the value of the consumption amount information with a value of zero, and in S333 executes the addition process using the replaced value.

In the third embodiment, the total consumption amount writing circuit 342 (the addition counter circuit 343) only permits updates of the total consumption amount information 391 to be a value higher than before the update. Accordingly, this configuration prevents erroneous writing of the total consumption amount information 391.

Fourth Embodiment

Figure 10:
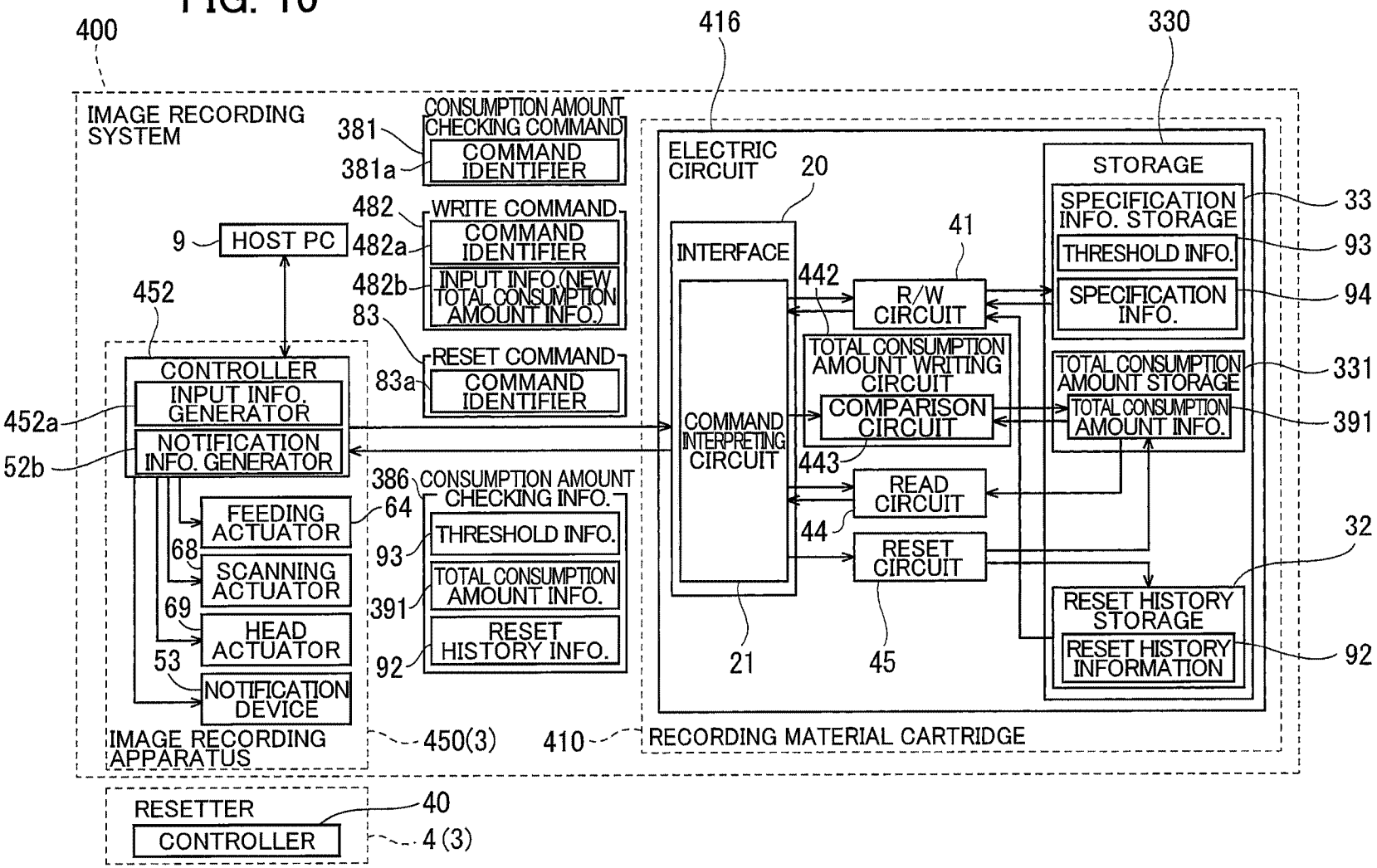
FIG. 10 is a block diagram illustrating a configuration of an image recording system according to a fourth embodiment.
Figure 11:
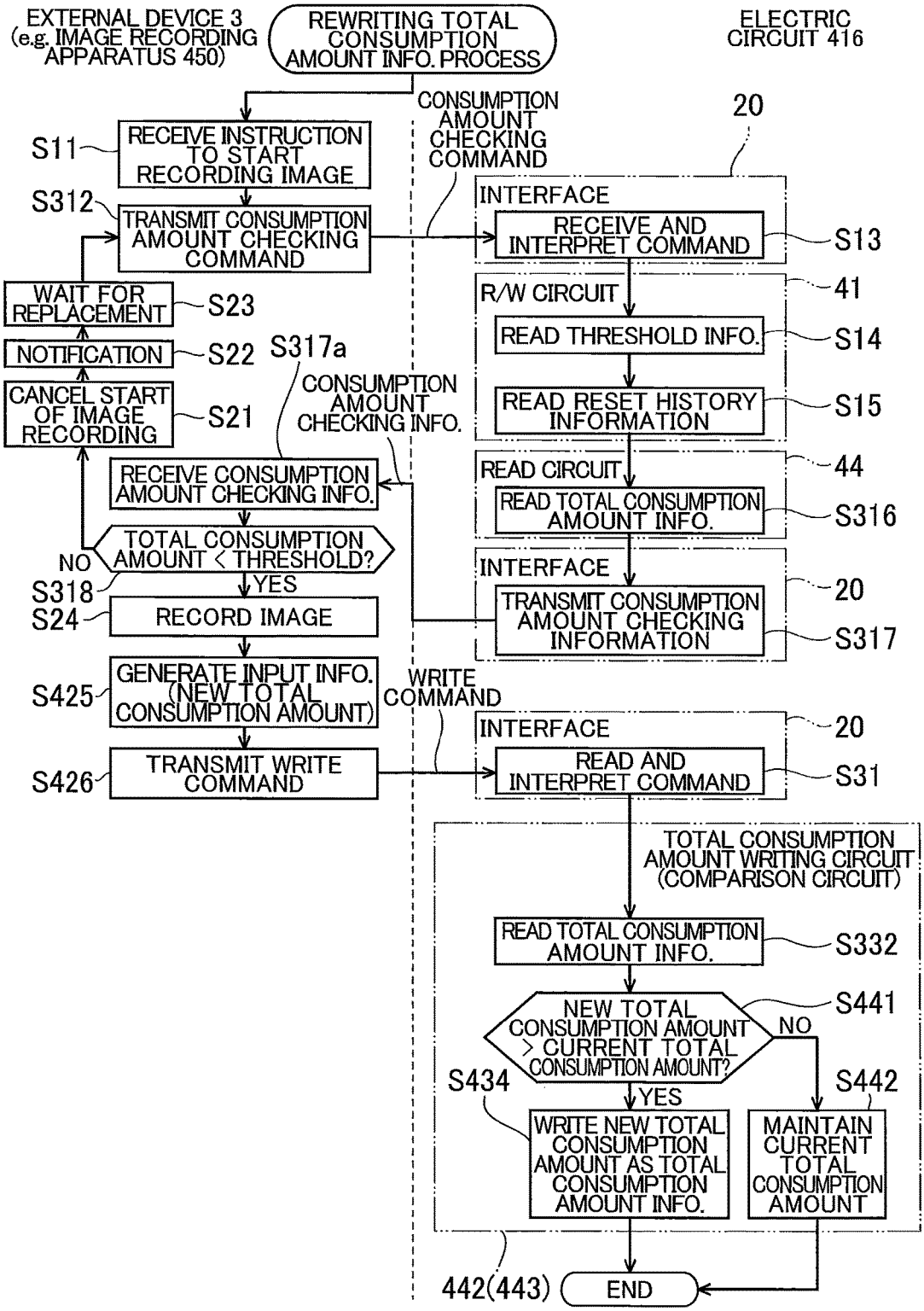
FIG. 11 is a flowchart illustrating a process of rewriting total consumption amount information according to the fourth embodiment.

Next, an image recording system 400 according to a fourth embodiment will be described with reference to FIGS. 10 and 11, wherein like parts and components are designated with the same reference numerals to avoid duplicating description. As illustrated in FIG. 10, an image recording system 400 includes an image recording apparatus 450 and a recording material cartridge 410. The image recording apparatus 450 include a controller 452 having an input information generator 452*a* and the notification information generator 52*b*. The recording material cartridge 410 includes an electrical circuit 416 having a total consumption amount writing circuit 442. The total consumption amount writing circuit 442 includes a comparison circuit 443.

Similarly to the third embodiment, the controller 452 reads out the consumption amount checking information 386 and determines whether the consumption amount is equal to or larger than the threshold value, that is, whether the consumption amount is small, on the basis of the consumption amount checking information 386. In the third embodiment, in S325 the controller 352 generates the information specifying the consumption amount of the recording material 1 as the input information 382*b* after the image recording process is performed in S24, and in S333 the electrical circuit 316 adds the consumption amount to the current total consumption amount. In the fourth embodiment, in S425 the input information generator 452*a* adds the consumption amount to the current total consumption amount, and the resultant sum is set as the value of new total consumption amount information and is included in input information 482*b*. Here, in S312 the controller 452 transmits the consumption amount checking command 381 to the interface 20 before an image is recorded in S24. As a response to the consumption checking command 381, the controller 452 received data on the current total consumption amount before the controller 452 generates the input information 482*b*. In S426 the controller 452 transmits a write command 482 to the electric circuit 416. The write command 282 includes a command identifier 482*a* and the generated input information 482*b*.

In S31 the command interpreting circuit 21 interprets the write command 482 based on the command identifier 482*a* input from the controller 452, and controls the total consumption amount writing circuit 442 to operate according to the command 482. The comparison circuit 443 compares the new total consumption amount with the current total consumption amount. The new total consumption amount is specified by the new total consumption amount information received via the interface 20 in S31. The current total consumption amount is specified by the total consumption amount information 391 currently stored in the total consumption amount storage 331. Specifically, in S332 the comparison circuit 443 accesses the total consumption amount storage 331 to read the total consumption amount information 391, similarly to the addition counter circuit 343 according to the third embodiment. In S441 the comparison circuit 443 compares the new total consumption amount with the current total consumption amount. In a case where the new total consumption amount is larger than the current total consumption amount (S441: YES), in S434 the comparison circuit 443 writes the new total consumption amount in the total consumption amount storage 331 as the updated total consumption amount information 391. In a case where the new total consumption amount is equal to or smaller than the current total consumption amount (S441: NO), in S442 the comparison circuit 443 maintains the current total consumption amount 391 stored in the total consumption amount storage 331 without overwriting the total consumption amount 391.

In the fourth embodiment, the total consumption amount writing circuit 442 (the comparison circuit 443) only permits updates of the total consumption amount information 391 to be a value higher than before the update. This configuration prevents erroneous writing of the total consumption amount information 391, similarly to the third embodiment.

The present specification contains the followings aspects. According to an aspect 1, a recording system includes an image recording apparatus, and a recording material cartridge configured to be attached to the image recording apparatus. The recording material cartridge includes a main body, and an electric circuit. The main body stores the recording material to be used in an image recordation process on a recording sheet by the image recording apparatus. The electric circuit is accommodated in the main body. The electric circuit includes a storage, an interface, and a reduction counter circuit. The storage stores residual amount information indicating a current residual amount of the recording material stored in the main body. The interface is configured to be electrically connected to an external apparatus including the image recording apparatus to communicate with the external apparatus. The interface is configured to receive consumption amount information on a consumption amount of the recording material. The reduction counter circuit is configured to: subtract the consumption amount based on the consumption amount information from the current residual amount to acquire the updated residual amount; and update the residual amount information in the storage so that the residual amount information indicates the updated residual amount in a case where the consumption amount is larger than zero. The reduction counter is configured to maintain the residual amount information in the storage so that the residual amount information keeps on indicating the current residual amount in a case where the consumption amount is smaller than or equal to zero. The image recording apparatus an attachment portion, an image recordation device, and a processor. The recording material cartridge is configured to be detachably attached to the attachment portion. The image recordation device is configured to perform an image recordation on a recording sheet by consuming the recording material supplied from the recording material cartridge. The processor is configured to be electrically connected to the electric circuit in a state where the recording material cartridge is attached to the attachment portion. The processor is configured to transmit the consumption amount information when the image recording device consumes the recording material.

According to an aspect 2 depending from the aspect 1, the processor is configured further to: receive the residual amount information from the electric circuit; and notify that the residual amount is small in a case where the residual amount based on the residual amount information is smaller than a prescribed threshold value.

According to an aspect 3, a recording system includes an image recording apparatus, and a recording material cartridge configured to be attached to the image recording apparatus. The recording material cartridge includes a main body, and an electric circuit. The main body stores the recording material to be used in an image recordation process on a recording sheet by the image recording apparatus. The electric circuit is accommodated in the main body. The electric circuit includes a storage, an interface, and a comparator circuit. The storage stores total consumption amount information indicating a current total consumption amount of the recording material stored in the main body. The interface is configured to be electrically connected to an external apparatus including the image recording apparatus to communicate with the external apparatus. The interface is configured to receive new residual amount information on an updated residual amount. The comparator circuit is configured to: compare the current residual amount with the updated residual amount based on the new residual amount information; and update the residual amount information in the storage so that the residual amount information indicates the update residual amount in a case where the updated residual amount is smaller than the current residual amount. The comparator circuit is configured to maintain the residual amount information in the storage so that the residual amount information keeps on indicating the current residual amount in a case where the updated residual amount is larger than or equal to the current residual amount information. The image recording apparatus an attachment portion, an image recordation device, and a processor. The recording material cartridge is configured to be detachably attached to the attachment portion. The image recordation device is configured to perform an image recordation on a recording sheet by consuming the recording material supplied from the recording material cartridge. The processor is configured to be electrically connected to the electric circuit in a state where the recording material cartridge is attached to the attachment portion. The processor is configured to transmit the new residual amount information when the image recording device consumes the recording material.

According to an aspect 4 depending from the aspect 3, the processor is configured further to: receive the residual amount information from the electric circuit; and notify that the residual amount is small in a case where the residual amount based on the residual amount information is smaller than a prescribed threshold value.

According to an aspect 5, a recording system includes an image recording apparatus, and a recording material cartridge configured to be attached to the image recording apparatus. The recording material cartridge includes a main body, and an electric circuit. The main body stores the recording material to be used in an image recordation process on a recording sheet by the image recording apparatus. The electric circuit is accommodated in the main body. The electric circuit includes a storage, an interface, and an addition circuit. The storage stores total consumption amount information indicating a current total consumption amount of the recording material stored in the main body. The interface is configured to communicate with an external apparatus including the image recording apparatus to communicate with the external apparatus. The interface is configured to receive consumption amount information on a consumption amount of the recording material. The addition circuit configured to: add the consumption amount based on the consumption amount information to the current total consumption amount to acquire the updated total consumption amount; and update the total consumption amount information in the storage so that the total consumption amount information indicates the updated total consumption amount in a case where the consumption amount is larger than zero. The addition circuit is configured to maintain the total consumption amount information in the storage so that the total consumption amount information keeps on indicating the current total consumption amount in a case where the consumption amount is smaller than or equal to zero. The image recording apparatus includes an attachment portion, an image recordation device, and a processor. The recording material cartridge is configured to be detachably attached to the attachment portion. The image recordation device is configured to perform an image recordation on a recording sheet by consuming the recording material supplied from the recording material cartridge. The processor is configured to be electrically connected to the electric circuit in a state where the recording material cartridge is attached to the attachment portion. The processor is configured to transmit the consumption amount information when the image recording device consumes the recording material.

According to an aspect 6 depending from the aspect 5, the processor is configured further to: receive the total consumption amount information from the electric circuit; and notify that a residual amount of the recording material stored in the main body is small in a case where the total consumption amount based on the total consumption amount information is larger than or equal to a prescribed threshold value.

According to an aspect 7, a recording system includes an image recording apparatus, and a recording material cartridge configured to be attached to the image recording apparatus. The recording material cartridge includes a main body, and an electric circuit. The main body stores the recording material to be used in an image recordation process on a recording sheet by the image recording apparatus. The electric circuit is accommodated in the main body. The electric circuit includes a storage, an interface, and a comparator circuit. The storage stores total consumption amount information indicating a current total consumption amount of the recording material stored in the main body. The interface is configured to communicate with an external apparatus including the image recording apparatus to communicate with the external apparatus. The interface is configured to communicate with an external apparatus including the image recording apparatus to communicate with the external apparatus. The interface is configured to receive new total consumption amount information on an updated total consumption amount. The comparator circuit is configured to: compare the current total consumption amount with the updated total consumption amount; and update the total consumption amount information in the storage so that the total consumption amount information indicates the updated total consumption amount in a case where the updated total consumption amount is larger than the current total consumption amount. The comparator circuit is configured to maintain the total consumption amount information in the storage so that the total consumption amount information keeps on indicating the current total consumption amount in a case where the updated total consumption amount is smaller than or equal to the current total consumption amount information. The image recording apparatus includes an attachment portion, an image recordation device, and a processor. The recording material cartridge is configured to be detachably attached to the attachment portion. The image recordation device is configured to perform an image recordation on a recording sheet by consuming the recording material supplied from the recording material cartridge. The processor is configured to be electrically connected to the electric circuit in a state where the recording material cartridge is attached to the attachment portion. The processor is configured to transmit the new total consumption amount when the image recording device consumes the recording material.

According to an aspect 8 depending from the aspect 5, the processor is configured further to: receive the total consumption amount information from the electric circuit; and notify that a residual amount of the recording material stored in the main body is small in a case where the total consumption amount based on the total consumption amount information is larger than or equal to a prescribed threshold value.

While the disclosure has been described in detail with reference to the above embodiments, it would be apparent to those skilled in the art that various changes and modifications or partial deletion may be made thereto. Any of configurations and processes according to the first to fourth embodiment may be combined properly.

What is claimed is:

1. A recording material cartridge configured to be attached to an image recording apparatus, the recording material cartridge comprising:

a main body storing the recording material to be used in an image recordation process on a recording sheet by the image recording apparatus; and an electric circuit accommodated in the main body, the electric circuit including:

a storage storing residual amount information indicating a current residual amount of the recording material stored in the main body;

an interface configured to be electrically connected to an external apparatus including the image recording apparatus to communicate with the external apparatus, the interface being configured to receive consumption amount information on a consumption amount of the recording material; and a reduction counter circuit configured to:

subtract the consumption amount based on the consumption amount information from the current residual amount to acquire the updated residual amount; and update the residual amount information in the storage so that the residual amount information indicates the updated residual amount in a case where the consumption amount is larger than zero, wherein the reduction counter is configured to maintain the residual amount information in the storage so that the residual amount information keeps on indicating the current residual amount in a case where the consumption amount is smaller than or equal to zero.

2. The recording material cartridge according to claim 1, wherein the interface is configured further to receive a reset command instructing to reset the residual amount information to indicate that the current residual amount is full, wherein the electric circuit further includes a reset portion configured to reset the residual amount information stored in the storage so that the residual amount information indicates that the current residual amount is full in response to the reset command.

3. The recording material cartridge according to claim 2, wherein in a case where the reset portion resets the residual amount information indicating that the current residual amount is full, the storage stores reset history information indicating that the reset portion resets the residual amount information indicating that the current residual amount is full.

4. The recording material cartridge according to claim 1, wherein in a case where the residual amount is smaller than a prescribed threshold value, the residual amount information is used for a notification process in which the image recording apparatus notifies that the residual amount is small.

5. A recording material cartridge configured to be attached to an image recording apparatus, the recording material cartridge comprising:

a main body storing the recording material to be used in an image recordation process on a recording sheet by the image recording apparatus; and an electric circuit accommodated in the main body, the electric circuit including:

a storage storing residual amount information indicating a current residual amount of the recording material stored in the main body;

an interface configured to be electrically connected to an external apparatus including the image recording apparatus to communicate with the external apparatus, the interface being configured to receive new residual amount information on an updated residual amount; and a comparator circuit configured to:

compare the current residual amount with the updated residual amount based on the new residual amount information; and update the residual amount information in the storage so that the residual amount information indicates the update residual amount in a case where the updated residual amount is smaller than the current residual amount, wherein the comparator circuit is configured to maintain the residual amount information in the storage so that the residual amount information keeps on indicating the current residual amount in a case where the updated residual amount is larger than or equal to the current residual amount information.

6. The recording material cartridge according to claim 5, wherein the interface is configured further to receive a reset command instructing to reset the residual amount information to indicate that the current residual amount is full, wherein the electric circuit further includes a reset portion configured to reset the residual amount information stored in the storage so that the residual amount information indicates that the current residual amount is full in response to the reset command.

7. The recording material cartridge according to claim 6, wherein in a case where the reset portion resets the residual amount information indicating that the current residual amount is full, the storage stores reset history information indicating that the reset portion resets the residual amount information indicating that the current residual amount is full.

8. The recording material cartridge according to claim 5, wherein in a case where the residual amount is smaller than a prescribed threshold value, the residual amount information is used for a notification process in which the image recording apparatus notifies that the residual amount is small.

9. A recording material cartridge configured to be attached to an image recording apparatus, the recording material cartridge comprising:

a main body storing the recording material to be used in an image recordation process on a recording sheet by the image recording apparatus; and an electric circuit accommodated in the main body, the electric circuit including:

a storage storing total consumption amount information indicating a current total consumption amount of the recording material stored in the main body;

an interface configured to communicate with an external apparatus including the image recording apparatus to communicate with the external apparatus, the interface being configured to receive consumption amount information on a consumption amount of the recording material; and an addition circuit configured to:

add the consumption amount based on the consumption amount information to the current total consumption amount to acquire the updated total consumption amount; and update the total consumption amount information in the storage so that the total consumption amount information indicates the updated total consumption amount in a case where the consumption amount is larger than zero, wherein the addition circuit is configured to maintain the total consumption amount information in the storage so that the total consumption amount information keeps on indicating the current total consumption amount in a case where the consumption amount is smaller than or equal to zero.

10. A recording material cartridge configured to be attached to an image recording apparatus, the recording material cartridge comprising:

a main body storing the recording material to be used in an image recordation process on a recording sheet by the image recording apparatus; and an electric circuit accommodated in the main body, the electric circuit including:

a storage storing total consumption amount information indicating a current total consumption amount of the recording material stored in the main body;

an interface configured to communicate with an external apparatus including the image recording apparatus to communicate with the external apparatus, the interface being configured to receive new total consumption amount information on an updated total consumption amount; and a comparator circuit configured to:

compare the current total consumption amount with the updated total consumption amount; and update the total consumption amount information in the storage so that the total consumption amount information indicates the updated total consumption amount in a case where the updated total consumption amount is larger than the current total consumption amount, wherein the comparator circuit is configured to maintain the total consumption amount information in the storage so that the total consumption amount information keeps on indicating the current total consumption amount in a case where the updated total consumption amount is smaller than or equal to the current total consumption amount information.

* * * * *